US005944352A

United States Patent [19]

Crouch et al.

[11] Patent Number: 5,944,352

[45] Date of Patent: Aug. 31, 1999

[54] NOTEBOOK BINDER DEVICE WITH A CENTRAL WINDOW

[76] Inventors: Jimmy Crouch, 63441 30th St., Lawton, Mich. 49065; Glenn N. Christoffel, 3997 Lafayette Rd., Jamesville, N.Y. 13078; Peter F. Lynch, P.O. Box 373; Scott W. Osiecki, 47 East St., both of Skaneateles, N.Y. 13152

[21] Appl. No.: 09/027,132

[22] Filed: Feb. 20, 1998

[51] Int. Cl.[6] ..... B42D 1/00

[52] U.S. Cl. ..... 281/21.1; 40/771; 40/772; 281/29; 281/37; D19/27

[58] Field of Search ..... 40/771, 772; 281/21.1, 281/29, 37; D19/26–33

[56] References Cited

U.S. PATENT DOCUMENTS

| | | | |
|---|---|---|---|
| 19,487 | 12/1858 | Hafely et al. . | |
| 206,206 | 7/1878 | Yerrinton | 281/37 |
| D. 341,373 | 11/1993 | Stern | D19/26 |
| D. 383,215 | 9/1997 | Levy | D24/225 |
| 870,771 | 11/1907 | Garman . | |
| 1,840,916 | 1/1932 | Pleasants, Jr. . | |
| 2,056,338 | 10/1936 | Bachrach | 40/102 |
| 2,289,949 | 7/1942 | Wisdom | 129/41 |
| 2,725,881 | 12/1955 | Goldman | 129/25 |
| 3,077,688 | 2/1963 | Friedman et al. | 40/158 |
| 3,208,772 | 9/1965 | Dahlstrand et al. | 283/63 |
| 3,252,462 | 5/1966 | Quarton et al. | 129/38 |
| 3,310,321 | 3/1967 | Freund | 281/31 |
| 4,629,349 | 12/1986 | Pitts | 402/74 |
| 4,640,413 | 2/1987 | Kaplan et al. | 206/232 |
| 4,741,655 | 5/1988 | James | 281/21.1 |
| 4,809,451 | 3/1989 | Suzuki | 40/158.1 |
| 4,991,767 | 2/1991 | Wyant | 229/1.5 R |
| 5,030,027 | 7/1991 | Bachrach et al. | 281/37 |
| 5,156,419 | 10/1992 | Minch | 281/21.7 |
| 5,362,103 | 11/1994 | Bromberg | 281/29 |
| 5,371,963 | 12/1994 | Gallagher | 40/158.1 |
| 5,542,708 | 8/1996 | Primlani | 281/21.1 |
| 5,598,969 | 2/1997 | Ong | 229/67.1 |
| 5,626,368 | 5/1997 | St. Romain | 281/29 |
| 5,662,447 | 9/1997 | Tsai | 281/29 |
| 5,674,021 | 10/1997 | Hutnick | 402/14 |
| 5,683,111 | 11/1997 | Bass et al. | 281/21.1 |
| 5,872,513 | 2/1999 | Ong | 281/29 |

*Primary Examiner*—Willmon Fridie, Jr.
*Assistant Examiner*—Monica Smith

[57] ABSTRACT

A notebook binder device having a first and second member. The first member having a front cover section. The front cover section having a central opening defining a window. The first member includes a connecting fold. The second member having a transparent, see through, cover and a back. When the first and second members are connected the back is viewed through the window and the transparent middle cover section. The second member includes a connecting fold suitable for connecting the connecting fold of the first member and for connecting the transparent cover section. Rivets and other connecting devices are adapted to connect the first and second members. Additionally, the rivets include male and female paper holding members for holding papers between the front and back covers.

20 Claims, 2 Drawing Sheets

NOTEBOOK BINDER DEVICE WITH A CENTRAL WINDOW

FIELD OF INVENTION

This invention relates generally to notebook binder devices for holding paper goods such as standard notebook three-ring binder type paper and more particularly to notebook binder devices having a central window in the front cover.

BACKGROUND OF THE INVENTION

Notebook binders have been known for many years. Typical examples of notebook binder devices are exemplified by Pitts, U.S. Pat. No. 4,629,349 which hold three-ring loose leaf paper. Other notebook binder devices include Garman, U.S. Pat. No. 870,771; Wyant, U.S. Pat. No. 4,991,767; Ong, U.S. Pat. No. 5,598,969; and St. Romain, U.S. Pat. No. 5,626,368.

Whether the binder be of the three-ring type device or whether it be of the kind where the papers are held in by friction, or an envelope, the notebook binder device has proven to be a useful and a extremely popular device for holding paper.

Other such devices include notebook binders wherein the outer cover includes a window or opening, so that the goods inside the binder, such as paper or the like, are visible without having to open the notebook binder. Such devices are exemplified by Freund, U.S. Pat. No. 3,310,321; Kaplan et al., U.S. Pat. No. 4,640,413; Levy, U.S. Pat. No. D 383,215; and Bass et al., U.S. Pat. No. 5,683,111. These binders have the advantage of allowing viewing at least a small portion of the paper goods while the notebook binder remains in the closed position.

Other notebook binder devices have a larger central opening or window where the materials held by the notebook binder are substantially more visible. Such devices are exemplified by Hafely, U.S. Pat. No. 19,487; and Pleasants, Jr., U.S. Pat. No. 1,840,916. These devices disclose a notebook binder device having a large central opening where a substantial portion of the paper goods contained within the notebook binder device may be viewed without opening the notebook binder. There are even notebook binder devices wherein the outside cover is substantially transparent. Such notebook binder device are exemplified by Bachrach, U.S. Pat. No. 2,056,338; Goldman, U.S. Pat. No. 2,725,881; Quarton et al., U.S. Pat. No. 3,252,462; Stern, U.S. Pat. No. D 341,373; and Hutnick, U.S. Pat. No. 5,674,021. Each of these references discloses a notebook binder device which discloses a substantially transparent cover page so that the entire front cover page of the paper goods contained within the notebook binder is visible.

What is not disclosed or shown, and what is desired in the industry is a notebook binder device wherein the front cover may have varying window sizes without affecting the notebook binder device's ability to protect the paper goods held within the notebook binder device.

SUMMARY OF THE INVENTION

It is an object of this invention to provide a notebook binder device wherein a front cover section defines a window which is varied without affecting the remaining portion of the notebook binder.

It is an additional object of this invention to provide a notebook binder device having two members wherein the front cover includes an opening of variable size.

It is an additional object of this notebook binder device to provide a paper protecting device which securely holds paper within the notebook binder device while accommodating three-ring paper and having a front cover with a central window portion.

In accordance with the above objects and those that will be mentioned and will become apparent below, the notebook binder device in accordance with this invention comprises:

- a first member having a cover section, the front cover section having a center opening and a first connecting fold;
- a second member having a middle cover section and a back cover section, and a second connecting fold adapted for connection to the first connecting fold; and
- connecting members for connecting a first and second members,
- whereby the first and second members are connectable with the three cover sections being connectable.

In a preferred embodiment of the notebook binder device in accordance of the invention, the first member first fold defines a V-fold which is adapted for connection with the second member.

In another preferred embodiment of the notebook binder device in accordance with this invention, includes a second fold comprising a M-fold having a first, two middle, and an end leg. The V-fold is inserted between the two middle legs of the M-fold, and is secured thereto by the connecting means.

In another exemplary embodiment in accordance with the invention, the connecting members appropriately include male and female paper holding members which are aligned to accommodate three-ring binder paper.

BRIEF DESCRIPTION OF THE DRAWING

For a further understanding of the objects and advantages of the present invention, reference should be had to the following brief description, taken in conjunction with the accompanying drawing, in which like parts are given like reference numerals and wherein.

DETAILED DESCRIPTION OF THE INVENTION

Figure 1:
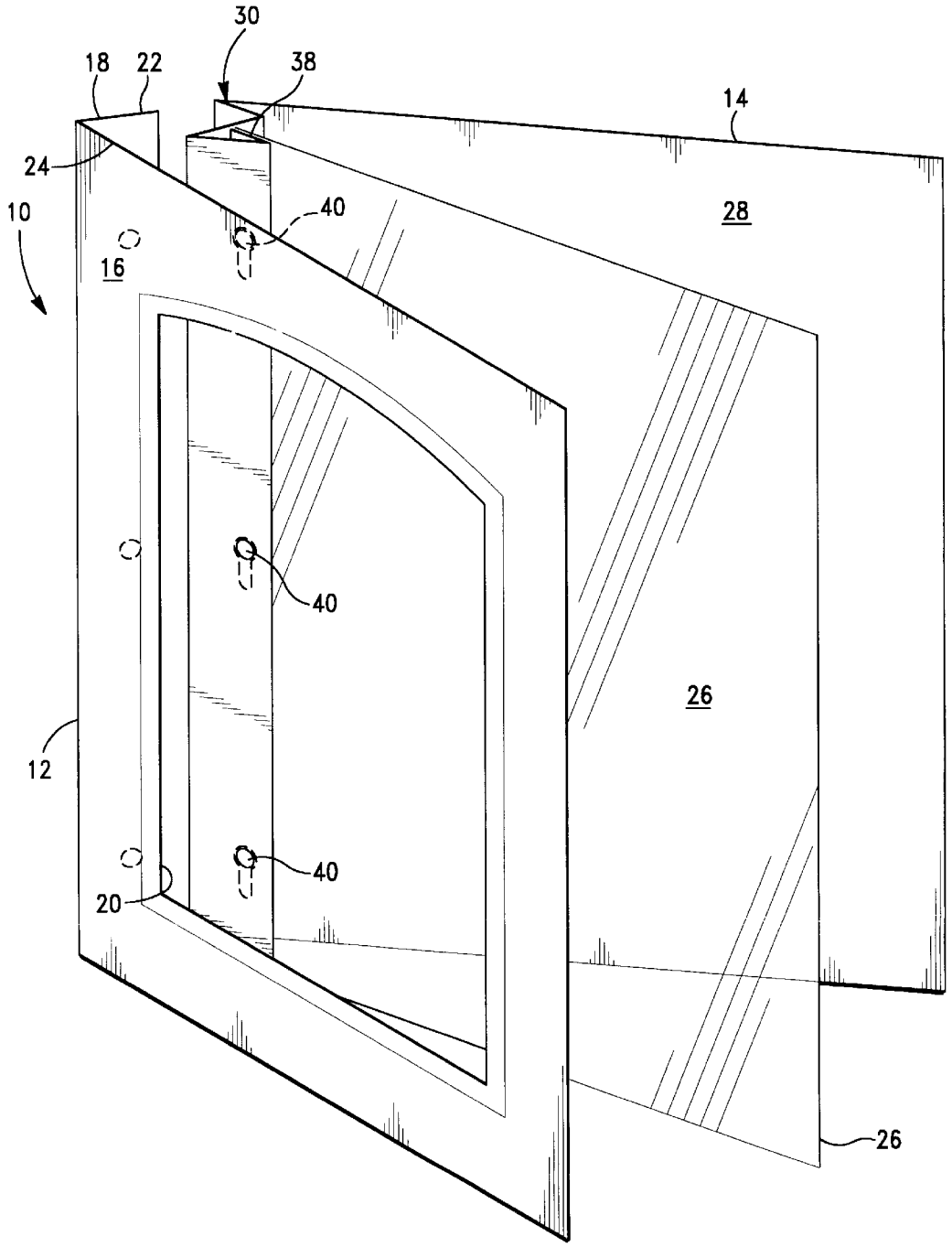
FIG. 1 is a perspective view of one embodiment of the notebook binder in accordance with the present invention.

As well be appreciated, the invention will be described without particular reference to the goods capable of being contained within the notebook binder of the invention, namely, paper. Although it will be appreciated that other goods fitting the physical requires of the binders size and shape are easily contained withing the device in accordance with this invention. It will also be appreciated that typical 3-ring notebook binder paper may be stored within the notebook binder of the invention and protected thereby. Although the invention is not so limited, it is a useful example in explaining the use and structure of the invention.

The invention will now be described with respect to FIG. 1, which illustrates a notebook binder in accordance with the invention, generally designated by the numeral 10.

The notebook binder 10 includes a first member 12 and a second member 14. The first member 12 includes a front cover section 16. Additionally, the first member 12 of notebook binder 10 includes a connecting fold 18, as shown clearly in FIGS. 1 and 4.

The front cover section 16 has a central opening 20. As will be appreciated, the central opening 20 defines a window through which the second member 14 can be viewed and even touched. The central opening 20, in effect, defines a window frame, albeit without the window. In effect the window frame, by analogy, is the window for central opening 20.

As clearly shown in FIG. 1, the central opening 20 substantially includes the entire surface of the front cover section 16. It will also be appreciated by those skilled in the art that this need not be the case. In another embodiment, not shown, only one third of the surface area of the front cover section 16 defines the central opening 20. In other embodiments, either a smaller or larger percentage than those described above may define the central opening 20. All such percentages are within the spirit and scope of this invention.

Figure 4:
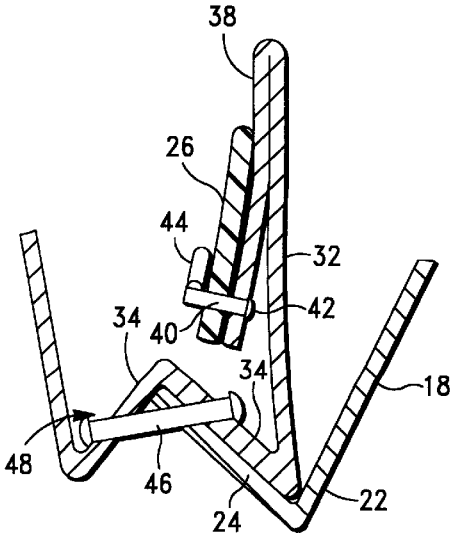
FIG. 4 is a cross sectional view of the notebook binder in accordance with FIG. 1 of the present invention.

The first connecting fold 18 defines a V-fold having a first leg 22 and a second leg 24. As illustrated in FIG. 4. the first leg 22 of the V-fold is adapted for connection with the second member 14.

The second member 14 includes a middle cover section 26 and a back cover section 28. Additionally, a second connecting fold, generally indicated by the numeral 30, is used in connecting the middle cover section 26 with the back cover section 28.

As shown in FIG. 1, the middle cover section 26 is made from transparent material so that paper inserted between the middle section 26 and the back cover 28 is protected, despite the central opening 20 affording no protection. The middle cover section 26 is preferably made from a transparent plastic, notably vinyl, although semi-transparent material is also within the spirit and scope of this invention.

The back cover section 28 is typically made from the same material as the front cover section 16. Although it is not necessary that the same material be used for both the front and back cover sections within the spirit and scope of the invention. This material can be an opaque paper or plastic, depending upon desired use and cost requirements. It will be readily appreciated that a variety of different materials for these cover sections, 16 and 28 respectively, are well within the scope and spirit of this invention.

As clearly illustrated in FIG. 4, the second connecting fold 30 defines an M-fold having a first leg 32, two middle legs 34, and an end leg 36. In the embodiment shown in FIGS. 1 and 4, the first leg includes a hiding fold 38. It is hiding fold 38 which is attached to the middle cover section 26, as clearly illustrated. A series of openings 40 pierce the hiding fold 38 and are aligned with the same series of openings 40 in the middle cover section 26. Once these openings are aligned, a rivet or other connecting member 42 is inserted through opening 40 and secured in place.

Additionally, connecting member 42 includes a male paper holding member 44 for insertion into paper to be secured in the notebook binder 10.

Additionally, openings 40 are aligned through middle legs 34. These openings represent a series of openings also in alignment with openings 40 in hiding fold 38.

Similarly, a series of openings 40 are found in first leg 22 of the front cover section 16. These openings 40 of the first leg 22 are aligned with openings 40 of the "M" fold as previously discussed.

The front cover section 16 is connected to the M-fold through openings 40 by a plurality of connecting members 46. The connecting members 46 have openings defining female paper holding members 48. The female paper holding members 48 are aligned with the male paper holding members 44 so that the male members fit into the female members openings. In use, three ring binder paper is placed between the middle cover section 26 and back cover section 28. The male members 44 are inserted through the paper holes and then through the female members 48. The male members 44 are then folded to secure the paper in place.

The male and female paper holding members, 44 and 48 respectively, are aligned by connecting members 46 upon connection of the front cover connecting fold 18 with the middle legs 34 of the second connecting fold 30.

Thus, when secured and completely connected together, the first and second members provide an open window in which the front page of a report can be clearly viewed, and even reviewed, while still being protected by the middle cover section 26.

Figure 2:
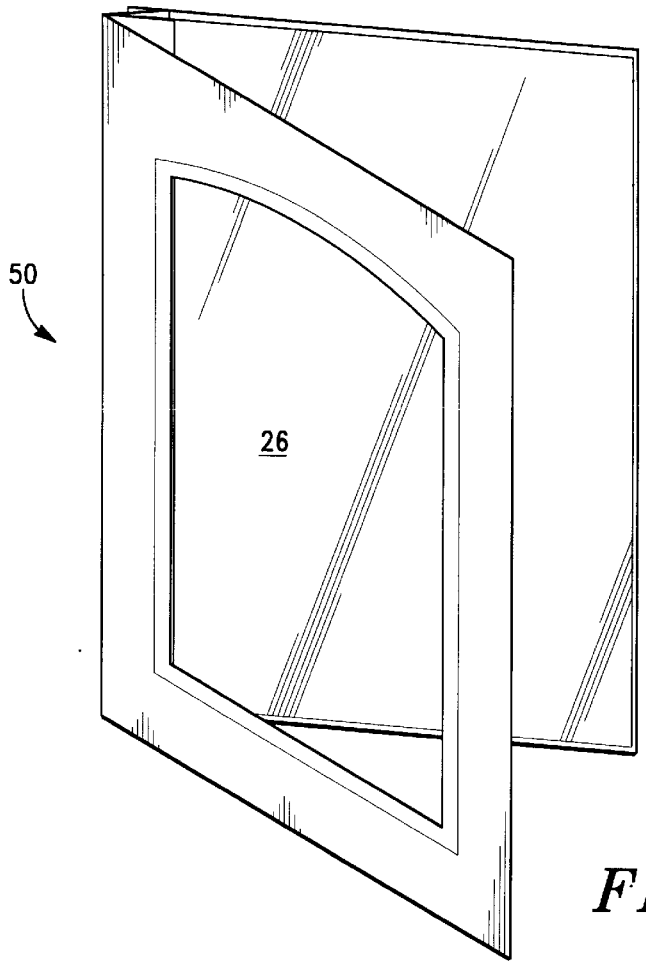
FIG. 2 is a perspective view of a second embodiment of the notebook binder in accordance with the present invention.
Figure 3:
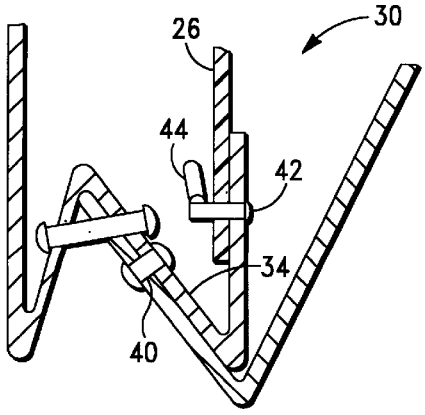
FIG. 3 is a cross sectional view of the notebook binder in accordance with FIG. 2 of the present invention.

With respect to the embodiment shown in FIG. 2, there is shown an alternative embodiment 50. The alternative embodiment 50 includes first and second cover members 12 and 14, with the exception that, as shown in FIG. 3, there is no hiding fold 38. Instead the openings 40 pierce the first leg 32, connect the middle cover section 26 to the second member. The connecting member 42 is inserted through the openings 40 and includes a male paper holder member 44.

FIG. 3 illustrates an alternative means of connecting the first and second members, 12 and 14 respectively. As shown in FIG. 3, it is within the spirit and scope of this invention for only one of the middle legs 34 to include the series of openings 40. The first leg 22 of the front cover section 16 has the aligned openings 40, as discussed above. The connecting member 46, having female paper holding member 48, is inserted through the openings 40, consistent with the manner described above, with respect to the embodiment described in FIGS. 1 and 4. Also, it may be appreciated that it may well be preferable to have openings 40 pierce both middle legs 34, such as is also illustrated in FIG. 3. In the latter embodiment, the first leg 22 of the V-fold fits between the middle legs 34 and is sandwiched thereby and secured thereto upon insertion of the connecting members 48 through each of the aligned openings 40. Each alternative may be preferable with given circumstances.

While the foregoing detailed description has described several embodiments of this invention, it is to be understood that the above description is illustrative only and not limiting of the disclosed invention. It will be appreciated that there are a number of attachment schemes which can be used within the spirit and scope of this invention and while those have not been mentioned, it would be readily appreciated that those several means are incorporated herein as being known to those reasonably skilled in the art. Thus, the invention is to be limited only by the claims as set forth below.

What is claimed is:

1. A notebook binder device, comprising:

a first member having a cover section, the front cover section having a center opening and a first connecting fold;

a second member having a middle cover section and a back cover section, and a second connecting fold adapted for connection to the first connecting fold; and connecting members for connecting a first and second members, whereby the first and second members are connectable with the three cover sections being connectable.

2. The notebook binder device as set forth in claim 1, wherein the first connecting fold defines a V-fold having first and second legs.

3. The notebook binder device as set forth in claim 2, wherein the first leg of the V-fold has a series of openings.

4. The notebook binder device as set forth in claim 3, wherein the series of openings in the first leg of the V-fold is spaced apart to accommodate a standard three ring binder and wherein the first connecting fold has similar openings for alignment with a three ring binder openings and wherein the second connecting fold has similar aligned openings and wherein the connecting members are adapted for attaching the first and second connecting folds together through their openings.

5. The notebook binder device as set forth in claim 1, wherein the second connecting fold defines an M-fold having a first, two middle, and an end leg.

6. The notebook binder device as set forth in claim 5, wherein the first leg of the M-fold is adapted for attachment to the middle cover section.

7. The notebook binder device as set forth in claim 5, wherein the first leg has a hiding fold and the hiding fold is adapted for attachment to the middle cover section.

8. The notebook binder device as set forth in claim 7, wherein the middle cover section and the hiding fold of the M-fold have a series of aligned openings, and the openings are aligned with one another such that the openings on the hiding leg are aligned with the openings on the middle cover section and the connecting members adapted for connecting the middle cover section to the hiding leg.

9. The notebook binder device as set forth in claim 8, wherein at least one of the middle legs and the front cover section have a series of openings aligned with the hiding fold openings, and the connecting members are adapted for connecting the front cover section to the second member through the aligned openings on the middle leg.

10. The notebook binder device as set forth in claim 9, wherein both middle legs include aligned openings and the front cover section is adapted for connecting the second member through the openings on both middle legs.

11. The notebook binder device as set forth in claim 9, wherein the connecting members are separate and independent for attaching the middle section and the front cover section to the second member.

12. The notebook binder device as set forth in claim 11, wherein the connecting members for attaching the middle cover section to the M-fold include male paper holding members and wherein the connecting members adapted for attaching the front cover section to the second member have female paper holding members.

13. The notebook binder device as set forth in claim 1, wherein the center opening defines a window frame which substantially includes the entire front cover section.

14. The notebook binder device as set forth in claim 1, wherein the center opening defines a window frame covering substantially one third of the front cover section.

15. The notebook binder device as set forth in claim 1, wherein the middle cover section defines a window a nd is made from transparent material.

16. The notebook binder device as set forth in claim 1, wherein the middle cover section defines a window and is made from semi-transparent material.

17. The notebook binder device as set forth in claim 1, wherein the first and second members, exclusive of the middle cover section, are made from paper.

18. The notebook binder device as set forth in claim 1, wherein the first and second members are made from plastic.

19. The notebook binder device for protecting paper goods, comprising:

a first member having a front cover section, the front cover section having a center opening defining a window and includes a first connecting fold;

a second member having a middle cover section and a back cover section, the middle cover section being made from material for protecting paper goods between the window and the back cover section, and includes a second connecting fold adapted for connection with the first connecting fold; and connecting members for connecting the first and second members, whereby paper goods inserted between the window and back section are protected by the middle cover section.

20. The notebook binder device for protecting paper goods, comprising:

a first member having a front cover section, the front cover section having a center opening defining a window and a first connecting fold;

a second member having a middle cover section and a back cover section, the middle cover section being made from transparent material for protecting paper goods between the window and the back cover section, a second connecting fold adapted for connection with the first connecting fold; and connecting members for connecting the first and second members, whereby paper goods inserted between the window and back section can be viewed through the window while being protected by the middle cover section.

* * * * *